US011352886B2

(12) United States Patent
Tallman et al.

(10) Patent No.: US 11,352,886 B2
(45) Date of Patent: Jun. 7, 2022

(54) COATED COMPONENTS HAVING ADAPTIVE COOLING OPENINGS AND METHODS OF MAKING THE SAME

(71) Applicant: General Electric Company, Schenectady, NY (US)

(72) Inventors: James Albert Tallman, Niskayuna, NY (US); Andrew Philip Shapiro, Niskayuna, NY (US); Gary Michael Itzel, Niskayuna, NY (US); Curtis Alan Johnson, Niskayuna, NY (US); Victor John Morgan, Niskayuna, NY (US); Jacob John Kittleson, Niskayuna, NY (US); Bradley Thomas Richards, Carmel, IN (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 16/754,302

(22) PCT Filed: Oct. 13, 2017

(86) PCT No.: PCT/US2017/056500
§ 371 (c)(1),
(2) Date: Apr. 7, 2020

(87) PCT Pub. No.: WO2019/074514
PCT Pub. Date: Apr. 18, 2019

(65) Prior Publication Data

US 2020/0240273 A1 Jul. 30, 2020

(51) Int. Cl.

| | |
|---|---|
| ***F01D 5/28*** | (2006.01) |
| ***F01D 5/18*** | (2006.01) |
| ***F01D 25/12*** | (2006.01) |

(52) U.S. Cl.
CPC ..... *F01D 5/182* (2013.01); *F01D 5/28* (2013.01); *F01D 25/12* (2013.01);
(Continued)

(58) Field of Classification Search
CPC . F01D 5/182; F01D 5/28; F01D 25/12; F05D 2230/31; F05D 2240/12; F05D 2240/30; F05D 2260/203
See application file for complete search history.

(56) References Cited

U.S. PATENT DOCUMENTS 3,698,834 A * 10/1972 Meginnis ..... F01D 5/184 416/96 R
4,312,186 A * 1/1982 Reider ..... F23R 3/002 60/754

(Continued)

FOREIGN PATENT DOCUMENTS

DE 10 2014 116796 A1 5/2015
EP 1 375 825 A1 1/2004

(Continued)

OTHER PUBLICATIONS

International Search Report of the International Searching Authority for PCT/US2017/056500 dated Jun. 5, 2018.

(Continued)

*Primary Examiner* — Justin D Seabe
*Assistant Examiner* — Theodore C Ribadeneyra
(74) *Attorney, Agent, or Firm* — Armstrong Teasdale LLP

(57) ABSTRACT

A component includes an outer wall that includes an exterior surface, and at least one plenum defined interiorly to the outer wall and configured to receive a cooling fluid therein. The component also includes a coating system disposed on the exterior surface. The coating system has a thickness. The component further includes a plurality of adaptive cooling openings defined in the outer wall. Each of the adaptive (Continued)

cooling openings extends from a first end inflow communication with the at least one plenum, outward through the exterior surface and to a second end covered underneath at least a portion of the thickness of the coating system.

20 Claims, 8 Drawing Sheets

(52) U.S. Cl.
CPC ..... *F05D 2230/31* (2013.01); *F05D 2240/12* (2013.01); *F05D 2240/30* (2013.01); *F05D 2260/203* (2013.01)

(56) References Cited

U.S. PATENT DOCUMENTS

| | | | | |
|---|---|---|---|---|
| 6,265,022 | B1 * | 7/2001 | Fernihough | F01D 5/28 427/142 |
| 7,556,476 | B1 | 7/2009 | Liang | |
| 9,752,440 | B2 * | 9/2017 | Miranda | F02C 3/04 |
| 9,897,006 | B2 * | 2/2018 | Miranda | F01D 5/188 |
| 9,938,899 | B2 * | 4/2018 | Miranda | F01D 5/187 |
| 10,415,396 | B2 * | 9/2019 | Bunker | F01D 5/187 |
| 10,458,251 | B2 * | 10/2019 | Gallier | F01D 5/282 |
| 10,612,391 | B2 * | 4/2020 | Rathay | F01D 5/143 |
| 10,689,984 | B2 * | 6/2020 | Varney | B22C 13/085 |
| 10,704,395 | B2 * | 7/2020 | Bunker | F01D 5/186 |
| 10,731,857 | B2 * | 8/2020 | Burd | F23R 3/002 |
| 10,766,105 | B2 * | 9/2020 | Henderkott | B23K 1/20 |
| 10,774,656 | B2 * | 9/2020 | Itzel | B22F 5/04 |
| 10,995,621 | B2 * | 5/2021 | Hafner | B23P 15/04 |
| 2003/0231955 | A1 | 12/2003 | Barry et al. | |
| 2007/0280832 | A1 * | 12/2007 | Liang | F01D 5/186 416/97 R |
| 2011/0189015 | A1 | 8/2011 | Shepherd | |
| 2012/0034075 | A1 * | 2/2012 | Hsu | F23R 3/005 415/178 |
| 2012/0145371 | A1 * | 6/2012 | Bunker | F01D 5/288 165/177 |
| 2012/0148769 | A1 | 6/2012 | Bunker et al. | |
| 2012/0163984 | A1 * | 6/2012 | Bunker | F04D 29/023 416/241 B |
| 2012/0276308 | A1 * | 11/2012 | Rebak | F01D 25/08 428/34.1 |
| 2013/0086784 | A1 * | 4/2013 | Bunker | F02C 7/12 29/402.03 |
| 2013/0101761 | A1 * | 4/2013 | Bunker | B22F 10/20 428/34.1 |
| 2013/0156600 | A1 * | 6/2013 | Bunker | F01D 5/186 416/97 R |
| 2013/0272850 | A1 * | 10/2013 | Bunker | F01D 5/189 415/116 |
| 2013/0294898 | A1 * | 11/2013 | Lee | F01D 5/186 415/177 |
| 2013/0302522 | A1 | 11/2013 | Eminoglu et al. | |
| 2015/0143792 | A1 | 5/2015 | Bunker | |
| 2017/0167388 | A1 | 6/2017 | Merry et al. | |

FOREIGN PATENT DOCUMENTS

| | | | |
|---|---|---|---|
| EP | 2 354 453 | A1 | 8/2011 |
| EP | 2 662 469 | A2 | 11/2013 |
| EP | 3 181 868 | A1 | 6/2017 |
| JP | S6217307 | A | 1/1987 |
| JP | 2017089633 | A | 5/2017 |

OTHER PUBLICATIONS

JPO Notice of Reasons for Refusal for Patent Application JP2020-519999 received Jun. 27, 2021; 12 pp.

* cited by examiner

COATED COMPONENTS HAVING ADAPTIVE COOLING OPENINGS AND METHODS OF MAKING THE SAME

BACKGROUND

The field of the disclosure relates generally to components that include internal cooling conduits, and more particularly to components that include an array of cooling openings defined in an outer wall, initially closed by an outer wall coating system, to facilitate adaptive cooling of the outer wall.

Some components, such as hot gas path components of gas turbines, are subjected to high temperatures. At least some such components have internal cooling conduits defined therein, such as but not limited to a network of plenums and passages, that circulate a cooling fluid internally, for example, along an interior surface of the outer wall of the component. In addition, at least some such components include a coating system, such as a thermal barrier coating and bond coat, on an exterior surface of the outer wall. The coating system and cooling fluid each facilitate maintaining one or more of the exterior surface of the outer wall, other portions of the wall or substrate material of the component, the thermal barrier coating, and the bond coat below a respective threshold temperature during operation. In at least some cases, local regions of the thermal bond coat can be become spalled or otherwise damaged over an operating lifetime of the component, and an increased overall flow rate of the cooling fluid is selected to compensate for the potential loss of protection from the thermal bond coat in spalled regions. For at least some components, the spalled regions could occur at any of a number of locations on the component and at any quantity at those locations, and thus the increased overall cooling fluid flow must be provided to the entire component, rather than just to targeted regions. This may result in unnecessary overcooling of regions that do not become spalled, and thus decreased operating efficiency.

BRIEF DESCRIPTION

In one aspect, a component is provided. The component includes an outer wall that includes an exterior surface, and at least one plenum defined interiorly to the outer wall and configured to receive a cooling fluid therein. The component also includes a coating system disposed on the exterior surface. The coating system has a thickness. The component further includes a plurality of adaptive cooling openings defined in the outer wall. Each of the adaptive cooling openings extends from a first end in flow communication with the at least one plenum, outward through the exterior surface and to a second end covered underneath at least a portion of the thickness of the coating system.

In another aspect, a rotary machine is provided. The rotary machine includes a combustor section configured to generate combustion gases, and a turbine section configured to receive the combustion gases from the combustor section and produce mechanical rotational energy therefrom. A path of the combustion gases through the rotary machine defines a hot gas path. The rotary machine also includes a component proximate the hot gas path. The component includes an outer wall that includes an exterior surface, and at least one plenum defined interiorly to the outer wall and configured to receive a cooling fluid therein. The component also includes a coating system disposed on the exterior surface. The coating system has a thickness. The component further includes a plurality of adaptive cooling openings defined in the outer wall. Each of the adaptive cooling openings extends from a first end in flow communication with the at least one plenum, outward through the exterior surface and to a second end covered underneath at least a portion of the thickness of the coating system.

In another aspect, a method of making a component is provided. The method includes forming an outer wall that encloses at least one plenum. The at least one plenum is configured to receive a cooling fluid therein. The outer wall includes an exterior surface and a plurality of adaptive cooling openings defined in the outer wall. The method also includes disposing a coating system on the exterior surface. The coating system has a thickness. Each of the adaptive cooling openings extends from a first end in flow communication with the at least one plenum, outward through the exterior surface and to a second end covered underneath at least a portion of the thickness of the coating system.

DRAWINGS

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms such as "about," "approximately," and "substantially" is not to be limited to the precise value specified. In at least some instances, the approximating language may correspond to the precision of an instrument for measuring the value. Here and throughout the specification and claims, range limitations may be identified. Such ranges may be combined and/or interchanged, and include all the sub-ranges contained therein unless context or language indicates otherwise.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

The exemplary components described herein overcome at least some of the disadvantages associated with known systems for internal cooling of a component. More specifically, the embodiments described herein include a plurality of adaptive cooling openings defined in an outer wall of a component. A coating is disposed on an exterior surface of the outer wall. Each opening extends from a first end in flow communication with at least one interior plenum of the component, outward through the exterior surface and to a second end covered underneath at least a portion of the thickness of the coating. After, for example, a spall event damages or removes the coating to a depth of the second end of the adaptive cooling openings, cooling fluid from an internal cooling fluid pathway is channeled through the adaptive cooling openings to an exterior of the component, providing additional localized cooling to mitigate, for example, the spall event.

Figure 1:
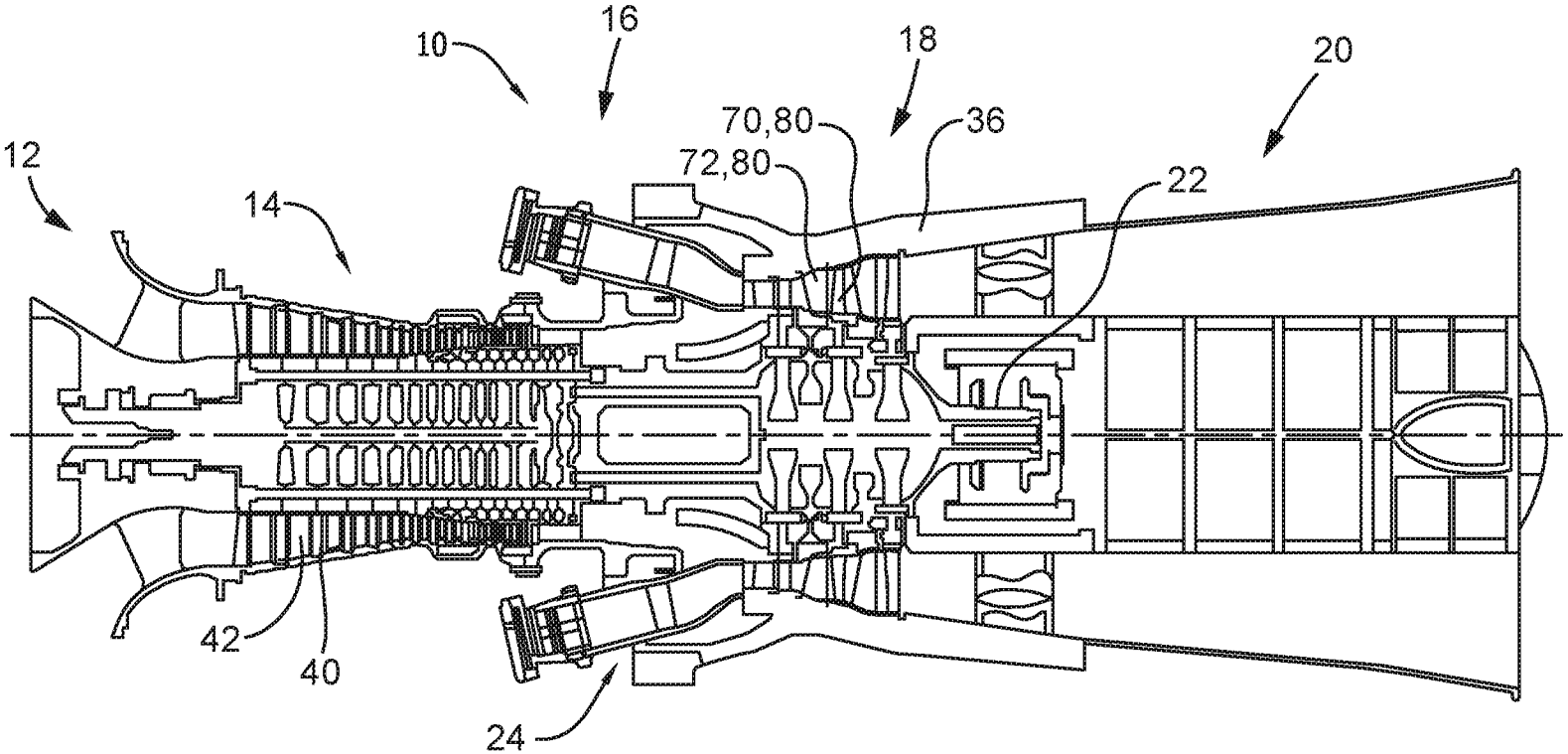
FIG. 1 is a schematic diagram of an exemplary rotary machine.

FIG. 1 is a schematic view of an exemplary rotary machine 10 having components for which embodiments of the current disclosure may be used. In the exemplary embodiment, rotary machine 10 is a gas turbine that includes an intake section 12, a compressor section 14 coupled downstream from intake section 12, a combustor section 16 coupled downstream from compressor section 14, a turbine section 18 coupled downstream from combustor section 16, and an exhaust section 20 coupled downstream from turbine section 18. A generally tubular casing 36 at least partially encloses one or more of intake section 12, compressor section 14, combustor section 16, turbine section 18, and exhaust section 20. In alternative embodiments, rotary machine 10 is any rotary machine for which components formed with internal passages as described herein are suitable. Moreover, although embodiments of the present disclosure are described in the context of a rotary machine for purposes of illustration, it should be understood that the embodiments described herein are applicable in any context that involves a component exposed to a high temperature environment.

In the exemplary embodiment, turbine section 18 is coupled to compressor section 14 via a rotor shaft 22. It should be noted that, as used herein, the term "couple" is not limited to a direct mechanical, electrical, and/or communication connection between components, but may also include an indirect mechanical, electrical, and/or communication connection between multiple components.

During operation of rotary machine 10, intake section 12 channels air towards compressor section 14. Compressor section 14 compresses the air to a higher pressure and temperature. More specifically, rotor shaft 22 imparts rotational energy to at least one circumferential row of compressor blades 40 coupled to rotor shaft 22 within compressor section 14. In the exemplary embodiment, each row of compressor blades 40 is preceded by a circumferential row of compressor stator vanes 42 extending radially inward from casing 36 that direct the air flow into compressor blades 40. The rotational energy of compressor blades 40 increases a pressure and temperature of the air. Compressor section 14 discharges the compressed air towards combustor section 16.

In combustor section 16, the compressed air is mixed with fuel and ignited to generate combustion gases that are channeled towards turbine section 18. More specifically, combustor section 16 includes at least one combustor 24, in which a fuel, for example, natural gas and/or fuel oil, is injected into the air flow, and the fuel-air mixture is ignited to generate high temperature combustion gases that are channeled towards turbine section 18.

Turbine section 18 converts the thermal energy from the combustion gas stream to mechanical rotational energy. More specifically, the combustion gases impart rotational energy to at least one circumferential row of rotor blades 70 coupled to rotor shaft 22 within turbine section 18. In the exemplary embodiment, each row of rotor blades 70 is preceded by a circumferential row of turbine stator vanes 72 extending radially inward from casing 36 that direct the combustion gases into rotor blades 70. Rotor shaft 22 may be coupled to a load (not shown) such as, but not limited to, an electrical generator and/or a mechanical drive application. The exhausted combustion gases flow downstream from turbine section 18 into exhaust section 20. A path of the combustion gases through rotary machine 10 defines a hot gas path of rotary machine 10. Components of rotary machine 10 are designated as components 80. Components 80 proximate the hot gas path are subjected to high temperatures during operation of rotary machine 10. In alternative embodiments, component 80 is any component in any application that is exposed to a high temperature environment.

Figure 2:
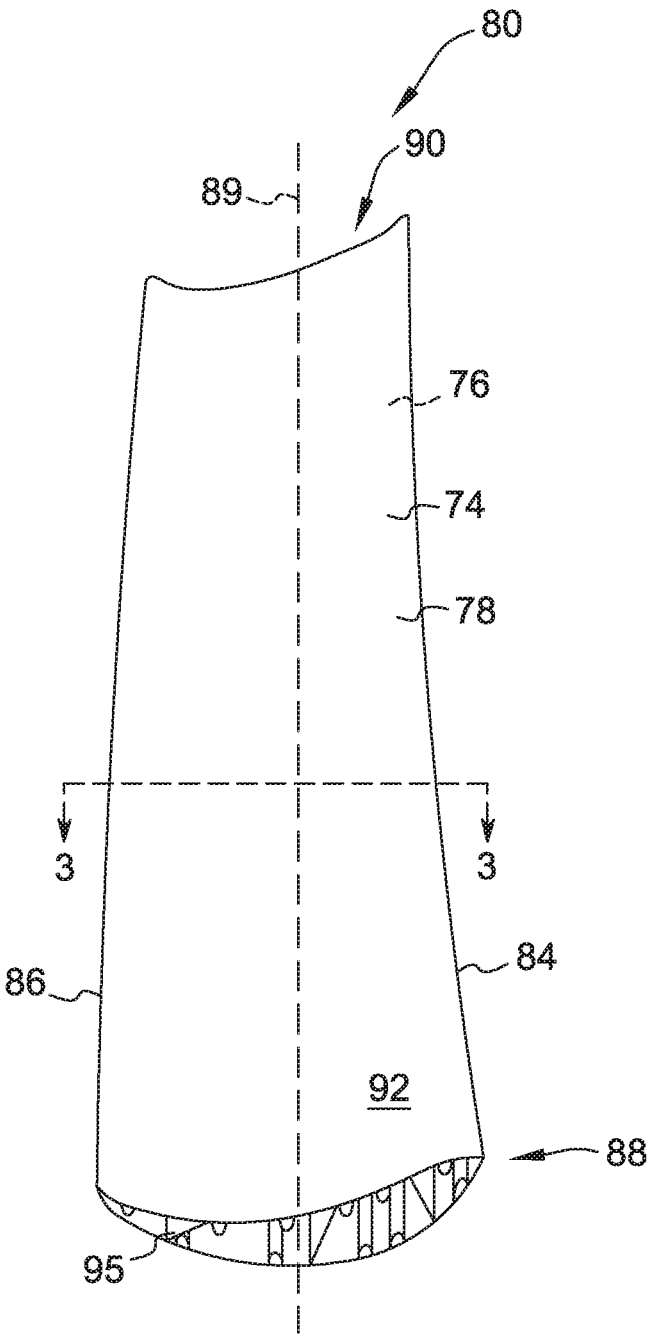
FIG. 2 is a schematic perspective view of an exemplary component for use with the rotary machine shown in FIG. 1.
Figure 3:
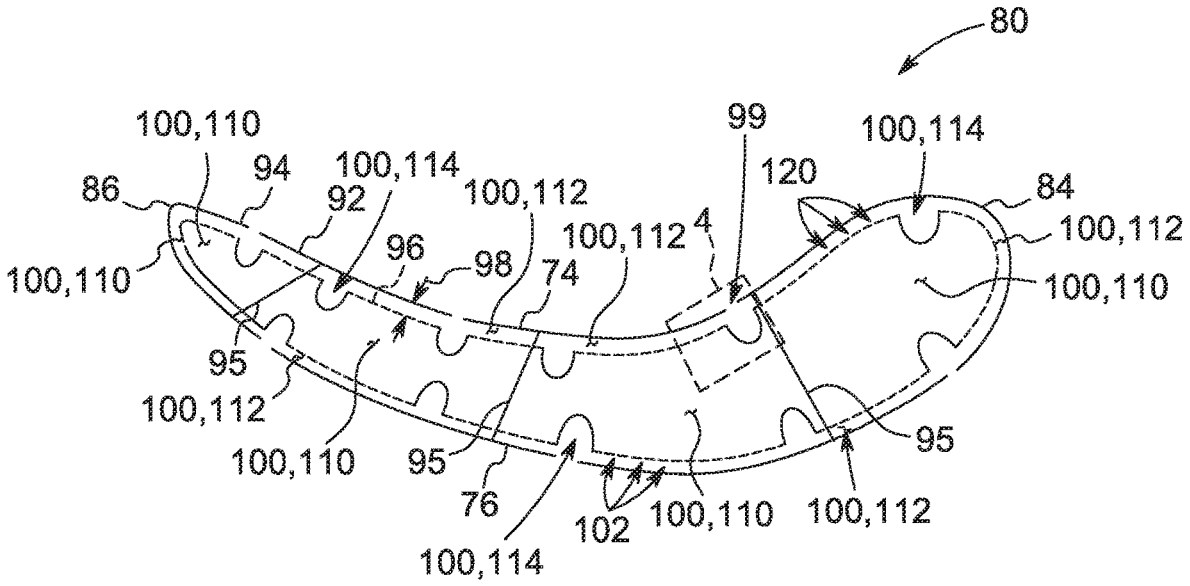
FIG. 3 is a schematic cross-section of the component shown in FIG. 2, taken along lines 3-3 shown in FIG. 2.
Figure 4:
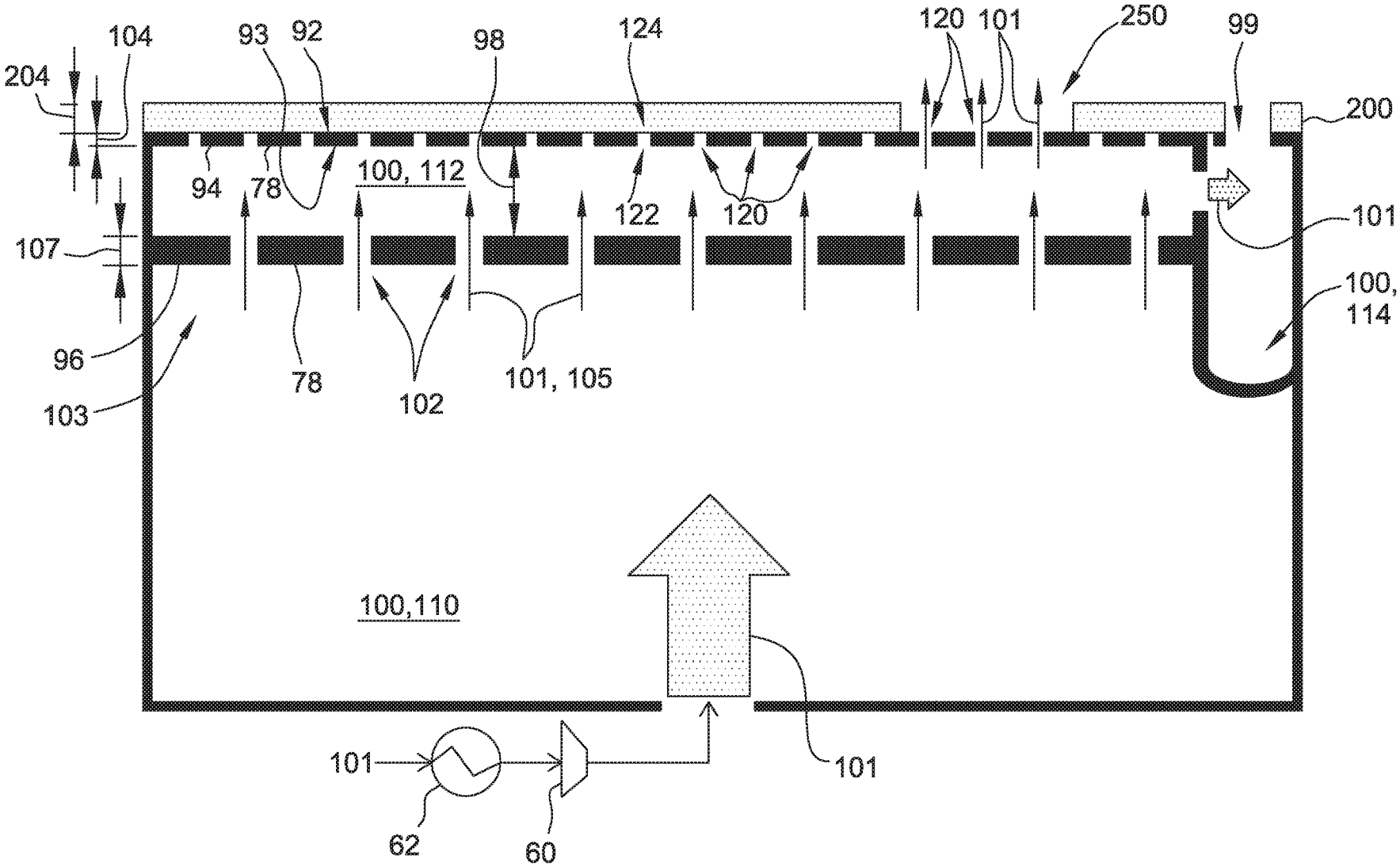
FIG. 4 is a schematic perspective sectional view of a portion of the component shown in FIGS. 2 and 3, designated as portion 4 in FIG. 3.

FIG. 2 is a schematic perspective view of an exemplary component 80, illustrated for use with rotary machine 10 (shown in FIG. 1). FIG. 3 is a schematic cross-section of component 80, taken along lines 3-3 (shown in FIG. 2). FIG. 4 is a schematic perspective sectional view of a portion of component 80, designated as portion 4 in FIG. 3. With reference to FIGS. 2-4, component 80 includes an outer wall 94 having a preselected thickness 104. Moreover, in the exemplary embodiment, component 80 includes at least one internal void 100 defined therein. For example, a cooling fluid 101 is provided to internal void 100 during operation of rotary machine 10 to facilitate maintaining component 80 below a temperature of the hot combustion gases.

Component 80 is formed from a component material 78. In the exemplary embodiment, component material 78 is a suitable nickel-based superalloy. In alternative embodiments, component material 78 is at least one of a cobalt-based superalloy, an iron-based alloy, and a titanium-based alloy. In other alternative embodiments, component material 78 is ceramic matrix composite (CMC). In still other alternative embodiments, component material 78 is any suitable material that enables component 80 to function as described herein.

In the exemplary embodiment, component 80 is one of rotor blades 70 or stator vanes 72. In alternative embodiments, component 80 is another suitable component of rotary machine 10. In still other embodiments, component 80 is any component in any application that is exposed to a high temperature environment.

In the exemplary embodiment, rotor blade 70, or alternatively stator vane 72, includes a pressure side 74 and an opposite suction side 76. Each of pressure side 74 and suction side 76 extends from a leading edge 84 to an opposite trailing edge 86. In addition, rotor blade 70, or alternatively stator vane 72, extends from a root end 88 to an opposite tip end 90. A longitudinal axis 89 of component 80 is defined between root end 88 and tip end 90. In alternative embodiments, rotor blade 70, or alternatively stator vane 72, has any suitable configuration that is capable of being formed with a preselected outer wall thickness as described herein.

Outer wall 94 at least partially defines an exterior surface 92 of component 80, and an interior surface 93 opposite exterior surface 92. In the exemplary embodiment, outer wall 94 extends circumferentially between leading edge 84 and trailing edge 86, and also extends longitudinally between root end 88 and tip end 90. In alternative embodiments, outer wall 94 extends to any suitable extent that enables component 80 to function for its intended purpose. Outer wall 94 is formed from component material 78.

In addition, the at least one internal void 100 includes at least one plenum 110 defined interiorly to outer wall 94. In the exemplary embodiment, each plenum 110 extends from root end 88 to proximate tip end 90. In alternative embodiments, each plenum 110 extends within component 80 in any suitable fashion, and to any suitable extent, that enables component 80 to function as described herein.

For example, in the embodiment illustrated in FIG. 4, component 80 includes an inner wall 96 positioned interiorly to outer wall 94, and the at least one plenum 110 is at least partially defined by inner wall 96 and interior thereto. In the exemplary embodiment, the at least one plenum 110 includes a plurality of plenums 110, each defined by inner wall 96 and at least one partition wall 95 that extends at least partially between pressure side 74 and suction side 76. For example, in the illustrated embodiment, each partition wall 95 extends from outer wall 94 of pressure side 74 to outer wall 94 of suction side 76. In alternative embodiments, at least one partition wall 95 extends from inner wall 96 of pressure side 74 to inner wall 96 of suction side 76. Additionally or alternatively, at least one partition wall 95 extends from inner wall 96 to outer wall 94 of pressure side 74, and/or from inner wall 96 to outer wall 94 of suction side 76. In other alternative embodiments, the at least one internal void 100 includes any suitable number of plenums 110 defined in any suitable fashion. Inner wall 96 is formed from component material 78.

Moreover, in some embodiments, at least a portion of inner wall 96 extends circumferentially and longitudinally adjacent at least a portion of outer wall 94 and is separated therefrom by an offset distance 98, such that the at least one internal void 100 also includes at least one chamber 112 defined between inner wall 96 and outer wall 94. In the exemplary embodiment, the at least one chamber 112 includes a plurality of chambers 112 each defined by outer wall 94, inner wall 96, and at least one partition wall 95. In alternative embodiments, the at least one chamber 112 includes any suitable number of chambers 112 defined in any suitable fashion. In the exemplary embodiment, inner wall 96 has a thickness 107 and defines a plurality of apertures 102 extending therethrough, such that each chamber 112 is in flow communication with at least one plenum 110.

In the exemplary embodiment, offset distance 98 is selected to facilitate effective impingement cooling of outer wall 94 by cooling fluid 101 supplied through plenums 110 and emitted through apertures 102 defined in inner wall 96 towards interior surface 93 of outer wall 94. For example, but not by way of limitation, offset distance 98 varies circumferentially and/or longitudinally along component 80 to facilitate local cooling requirements along respective portions of outer wall 94. In alternative embodiments, offset distance 98 is selected in any suitable fashion. Also in the exemplary embodiment, apertures 102 are arranged in a pattern 103 selected to facilitate effective impingement cooling of outer wall 94. For example, but not by way of limitation, pattern 103 varies circumferentially and/or longitudinally along component 80 to facilitate local cooling requirements along respective portions of outer wall 94. In alternative embodiments, pattern 103 is selected in any suitable fashion.

In some embodiments, apertures 102 are each sized and shaped to emit cooling fluid 101 therethrough in an impingement jet 105 towards interior surface 93. For example, apertures 102 each have a substantially circular or ovoid cross-section. In alternative embodiments, apertures 102 each have any suitable shape and size that enables apertures 102 to be function as described herein.

In the exemplary embodiment, outer wall 94 substantially carries an operational load of component 80, while inner wall 96 and/or partition walls 95 are formed by at least one insert baffle that carries very little loading. In alternative embodiments, inner wall 96 and/or partition walls 95 are formed integrally with outer wall 94 and/or carry a significant portion of the operational load of component 80.

Also in the exemplary embodiment, outer wall 94 defines a boundary between component 80 and the hot gas environment, and has a thickness 104 selected to facilitate effective cooling of outer wall 94 with a reduced flow of cooling fluid 101 as compared to components having thicker outer walls. In alternative embodiments, outer wall thickness 104 is any suitable thickness that enables component 80 to function for its intended purpose. In certain embodiments, outer wall thickness 104 varies along outer wall 94. In alternative embodiments, outer wall thickness 104 is constant along outer wall 94.

In the exemplary embodiment, outer wall 94 includes exhaust openings 99 extending therethrough that, upon entry of component 80 into service, are not obstructed by a coating system 200 (described below) and that exhaust cooling fluid 101 from chambers 112 therethrough to provide a baseline film cooling of an exterior of outer wall 94, in addition to the adaptive cooling described below. In alternative embodiments, outer wall 94 does not include exhaust openings 99, and the at least one internal void 100 further includes at least one return channel 114 in flow communication with at least one chamber 112, such that each return channel 114 provides a return fluid flow path for cooling fluid 101 used for impingement cooling of outer wall 94. In other alternative embodiments, component 80 includes both exhaust openings 99 and return channels 114. Although the at least one internal void 100 is illustrated as including plenums 110, chambers 112, and, optionally, return channels 114 for use in cooling component 80 that is one of rotor blades 70 or stator vanes 72, it should be understood that in alternative embodiments, component 80 is any suitable component for any suitable application, and includes any suitable number, type, and arrangement of internal voids 100 that enable component 80 to function for its intended purpose. For example, in some embodiments, component 80 is not configured for impingement cooling of outer wall 94.

In the exemplary embodiment, component 80 further includes coating system 200 disposed on exterior surface 92 of outer wall 94. Coating system 200 is formed from at least one material selected to protect outer wall 94 from the high temperature environment. For example, as described in more detail with respect to FIG. 7, coating system 200 includes a suitable bond coat layer adjacent to, and configured to adhere to, exterior surface 92, and one or more suitable thermal barrier outer layers adjacent to the bond coat layer. In alternative embodiments, coating system 200 is formed from any suitable material or combination of materials, applied in any suitable combination of layers and thicknesses. Coating system 200 has a total thickness 204. For clarity of illustration, coating system 200 is hidden in FIG. 2.

For example, during operation, cooling fluid 101 is supplied to plenums 110 through root end 88 of component 80. As the cooling fluid flows generally towards tip end 90, jets 105 of cooling fluid 101 are forced through apertures 102 into chambers 112 and impinge upon interior surface 93 of outer wall 94. In the exemplary embodiment, the used cooling fluid 101 then flows through exhaust openings 99 extending through outer wall 94 and coating system 200. For example, cooling fluid 101 is exhausted into the working fluid through predefined, unobstructed exhaust openings 99 to facilitate a baseline film cooling of exterior surface 92 and coating system 200, in addition to the adaptive cooling described below.

In alternative embodiments, the used cooling fluid 101 is channeled into return channels 114 and flows generally toward root end 88 and out of component 80. In some such embodiments, the arrangement of the at least one plenum 110, the at least one chamber 112, and the at least one return channel 114 forms a portion of a cooling circuit of rotary machine 10, such that used cooling fluid 101 is returned to a working fluid flow through rotary machine 10 upstream of combustor section 16 (shown in FIG. 1). In other alternative embodiments, component 80 includes both return channels 114 and exhaust openings 99, a first portion of cooling fluid 101 is returned to a working fluid flow through rotary machine 10 upstream of combustor section 16 (shown in FIG. 1), and a second portion of cooling fluid 101 is exhausted into the working fluid through exhaust openings 99 to facilitate baseline film cooling of exterior surface 92 and coating system 200. Although impingement flow through plenums 110 and chambers 112 and, optionally, exhaust flow through exhaust openings 99 or return flow through channels 114 is described in terms of embodiments in which component 80 is rotor blade 70 and/or stator vane 72, a circuit of plenums 110, chambers 112, exhaust openings 99 and/or return channels 114 is suitable for any component 80 of rotary machine 10, and additionally for any suitable component 80 for any other application.

Outer wall 94 includes a plurality of adaptive cooling openings 120 defined therein and extending therethrough. More specifically, adaptive cooling openings 120 each extend from a first end 122, in flow communication with the at least one plenum 110, outward through exterior surface 92 and to a second end 124. In the exemplary embodiment, first end 122 is defined in and extends through interior surface 93 of outer wall 94, and is in flow communication with the at least one plenum 110 via the at least one chamber 112. In alternative embodiments, first end 122 is defined at any suitable location within outer wall 94 that is in flow communication with the at least one plenum 110. For example, first end 122 is coupled in flow communication with a channel 170 that extends generally parallel to exterior surface 92 within outer wall 94, as described herein with respect to FIG. 11.

In some embodiments, and as illustrated in FIG. 4, second end 124 is defined at and extends through exterior surface 92 of outer wall 94, such that second end 124 is underneath an entirety of thickness 204 of coating system 200. In other embodiments, second end 124 is defined in coating system 200 such that adaptive cooling opening 120 extends partially into coating system 200, as will be described herein with respect to FIG. 7. In either case, in the exemplary embodiment, upon entry of component 80 into service, second end 124 of each adaptive cooling opening 120 is covered underneath at least a portion of thickness 204 of coating system 200, such that coating system 200 at least partially obstructs exhaustion of cooling fluid 101 through outer wall 94 via adaptive cooling openings 120. In other words, upon entry of component 80 into service, adaptive cooling openings 120 are at least partially obstructed by coating system 200. In some such embodiments, coating system 200 is porous such that, during operation, a portion of cooling fluid 101 escapes through adaptive cooling openings 120 even while coating system 200 is intact above adaptive cooling openings 120, to further facilitate a baseline film cooling of exterior surface 92 of outer wall 94 and coating system 200. In other such embodiments, coating system 200 is non-porous, such that coating system 200 effectively dead-ends adaptive cooling openings 120 while coating system 200 is intact above adaptive cooling openings 120.

Figure 5:
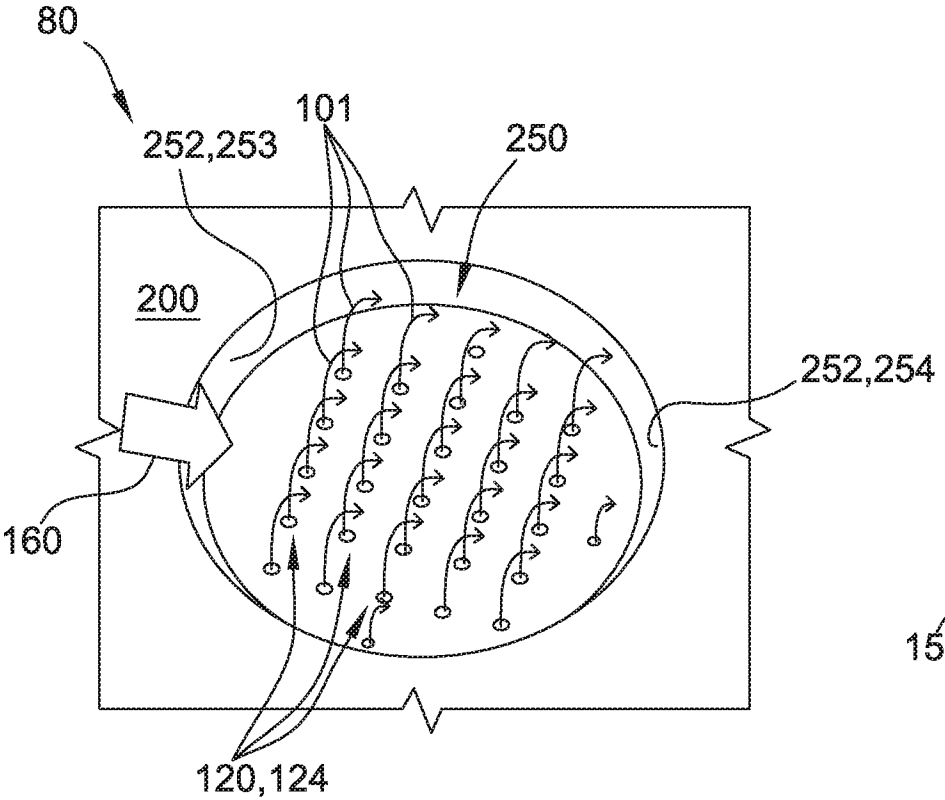
FIG. 5 is a schematic perspective sectional view of an exemplary outer wall of the component shown in FIG. 4, including an exemplary spalled region.

Also illustrated in FIG. 4 is an exemplary spalled region 250 from which at least a portion of coating system 200 has been removed while component 80 is in service. FIG. 5 is a perspective view of outer wall 94 of component 80 including the exemplary spalled region 250. For example, region 250 is created when coating system 200 is spalled or otherwise degraded by the high temperature environment during operation of rotary machine 10 (shown in FIG. 1). In some embodiments, component 80 is one of rotor blades 70 or stator vanes 72 of rotary machine 10 (shown in FIG. 1), and spalled region 250 is formed along leading edge 84 of component 80. In alternative embodiments, component 80 is any component in any application that is exposed to a high temperature environment, and/or spalled region 250 is formed in any location on component 80.

In the embodiment illustrated in FIGS. 4 and 5, an entire thickness 204 of coating system 200 has been removed from spalled region 250, directly exposing exterior surface 92 to a high temperature operating environment. In alternative embodiments, only a portion of thickness 204 is removed or damaged in spalled region 250. For example, an outer layer of coating system 200 delaminates in spalled region 250, as will be described in more detail herein with respect to FIGS. 7 and 8.

Damage to or removal of coating system 200 results in increased thermal exposure of outer wall 94, and an exposed portion 252 of coating system 200, in spalled region 250. Adaptive cooling openings 120 enable component 80 to adapt to the increased need for cooling in spalled region 250. More specifically, as coating system 200 is removed, second end 124 of each adaptive cooling opening 120 within spalled region 250 becomes completely unobstructed, creating a flow channel for cooling fluid 101 to pass from the at least one plenum 110 through adaptive cooling openings 120 to an exterior of outer wall 94, thereby providing additional localized cooling (e.g., bore cooling and/or exterior film cooling) for outer wall 94 and exposed portions 252 of coating system 200 in spalled region 250, in addition to the cooling initially provided by the internal cooling circuit within component 80.

Because unobstructed flow through adaptive cooling openings 120 occurs only within spalled region 250, the resulting adaptive cooling response is self-modulated in response to a size and location of spalled region 250. In certain embodiments, although a total flow rate of cooling fluid 101 for component 80 must account for potential spalled regions 250 to develop, an overall flow requirement for cooling fluid 101 for component 80 nevertheless is decreased relative to a similar component designed to include permanent through-openings over larger regions of outer wall 94, because the exhaust of cooling flow is adaptively limited to spalled regions 250 created while component 80 is in service. Moreover, in some embodiments, the cooling provided by adaptive cooling openings 120 facilitates mitigation of the spallation event, for example by maintaining an integrity of outer wall 94 and/or exposed portions 252 of coating system 200 in region 250 and preventing a size of spalled region 250 from growing.

In some embodiments, the system in which component 80 is installed, such as rotary machine 10 (shown in FIG. 1) in the exemplary embodiment, includes additional subsystems configured to modify at least one property of cooling fluid 101 supplied to component 80 in response an occurrence of spalled regions 250. For example, in some such embodiments, the system includes an auxiliary compressor 60 upstream of component 80. Auxiliary compressor 60 increases a pressure, and thus a flow rate, of cooling fluid 101 supplied to the at least one plenum 110 to account for the additional flow required to feed adaptive cooling openings 120 in spalled region 250. Additionally, in some such embodiments, the system includes a heat exchanger 62 upstream from auxiliary compressor 60 and configured to reduce a temperature of cooling fluid 101. For example, heat exchanger 62 reducing a temperature of cooling fluid 101 facilitates subsequent compression of cooling fluid 101 by auxiliary compressor 60, and/or improves a cooling effectiveness of cooling fluid 101 provided to component 80. Alternatively, auxiliary compressor 60 is used without heat exchanger 62.

In certain embodiments, operation of auxiliary compressor 60 and, if present, heat exchanger 62 is selectively adjusted based on a time-in-service of a plurality of components 80 in the system. For example, a certain level of spalling or other damage to components 80 is assumed based on the time-in-service, and auxiliary compressor 60 and heat exchanger 62 are adjusted to boost the flow and/or cooling effectiveness of cooling fluid 101 in response to the assumed level of damage. Alternatively, in some embodiments, auxiliary compressor 60 and heat exchanger 62 are actively controlled based on at least one suitable measured operating parameter of the system. For example, a detected change in value of the at least one measured operating parameter indicates that a threshold volume of cooling fluid 101 is flowing through spalled regions 250 of the plurality of components, and in response auxiliary compressor 60 and heat exchanger 62 are automatically controlled to increase a flow rate and/or cooling effectiveness of cooling fluid 101. In alternative embodiments, auxiliary compressor 60 and heat exchanger 62 are operated in any suitable fashion that enables auxiliary compressor 60 and heat exchanger 62 to function as described herein. In other alternative embodiments, the system does not include auxiliary compressor 60 and heat exchanger 62.

Figure 6:
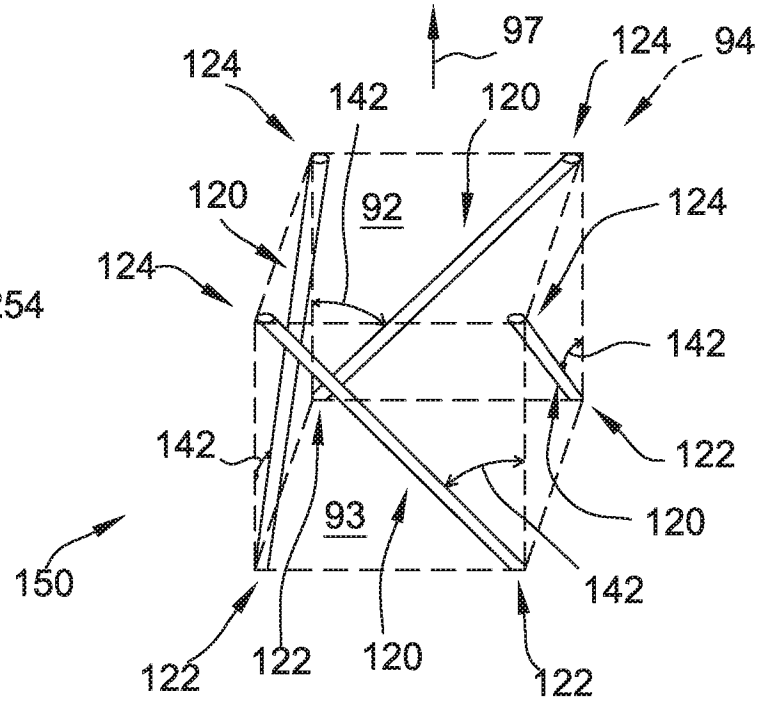
FIG. 6 is a schematic perspective view of an alternative orientation of exemplary adaptive cooling openings that may be used in the outer wall shown in FIG. 5.

Although adaptive cooling openings 120 are illustrated in FIGS. 4 and 5 as each extending from first end 122 to second end 124 in a direction generally normal to outer wall 94, in certain embodiments an orientation of at least one adaptive cooling opening 120 is other than normal to outer wall 94. More specifically, with reference to FIG. 6, in certain embodiments, at least one adaptive cooling opening 120 is oriented at an acute angle, measured with respect to a direction 97 normal to outer wall 94. One such embodiment is illustrated in FIG. 6, which is a schematic perspective view of an exemplary arrangement 150 of adaptive cooling openings 120 that may be used in outer wall 94. In FIG. 6, a portion of outer wall 94 surrounding arrangement 150 of adaptive cooling openings 120 is rendered transparent, in dashed lines, for ease of illustration.

In the exemplary embodiment, each adaptive cooling opening 120 is oriented at the same acute angle 142 measured with respect to normal direction 97, although the direction of rotation may differ, as discussed further below. In alternative embodiments, acute angle 142 of at least one adaptive cooling opening 120 differs in magnitude from acute angle 142 of another of adaptive cooling opening 120. In certain embodiments, each acute angle 142 is selected to be in a range from about 30 degrees to about 60 degrees. More specifically, in the exemplary embodiment, each acute angle 142 is selected to be about 37 degrees. In alternative embodiments, each acute angle 142 is selected to be any suitable magnitude that enables adaptive cooling openings 120 to function as described herein. In some embodiments, adaptive cooling openings 120 oriented at acute angles 142 facilitates increased cooling of coating system 200 along exposed portions 252 of spalled region 250 (shown in FIG. 5). More specifically, in some such embodiments, adaptive cooling openings 120 oriented at acute angles 142 direct cooling fluid 101 at least partially toward exposed portions 252, rather than in normal direction 97, which is generally parallel to an edge of exposed portions 252. For example, cooling fluid 101 directed at least partially toward exposed portions 252 increases cooling of exposed portions 252, thereby inhibiting coating system 200 from overheating and spalling further.

In the exemplary embodiment, arrangement 150 is formed by repeating groups of adaptive cooling openings 120 distributed across outer wall 94 (one group is illustrated), and each adaptive cooling opening 120 in the group is rotated by acute angle 142 in a different direction from other adaptive cooling openings 120 in the group. Thus, regardless of where spalled region 250 forms on exterior surface 92, at least one of adaptive cooling openings 120 will be oriented at least partially toward exposed portions 252 of coating system 200, facilitating increased cooling of exposed portions 252 and thereby inhibiting spalled region 250 from growing.

For example, in the illustrated embodiment, each of the repeating groups in arrangement 150 includes four adaptive cooling openings 120 arranged on four respective sides of a cubic section of outer wall 94. Each adaptive cooling opening 120 in the group is rotated through acute angle 142 in a different direction, and the direction of rotation is advanced by 90 degrees with respect to an adjacent adaptive cooling opening 120 of the group. As a result, first end 122 of each adaptive cooling opening 120 is positioned directly underneath second end 124 of an adjacent adaptive cooling opening 120. The illustrated arrangement 150 further facilitates having at least one of adaptive cooling openings 120 oriented at least partially toward exposed portions 252 of coating system 200, regardless of where spalled region 250 forms on exterior surface 92. In alternative embodiments, each group in arrangement 150 includes any suitable number and orientation of adaptive cooling openings 120 that enables arrangement 150 to function as described herein.

In alternative embodiments, at least some adaptive cooling openings 120 in each group are rotated by acute angle 142 in the same direction. For example, in some embodiments, outer wall 94 is exposed to a known, generally consistent direction of external flow 160 (shown in FIG. 5), such as the local direction of working fluid flow through rotary machine 10 (shown in FIG. 1). Adaptive cooling openings 120 are each oriented such that second end 124 is at least partially tilted into, i.e. at least partially facing, the direction of oncoming external flow 160. Thus, upon creation of spalled region 250, each adaptive cooling opening 120 channels cooling fluid 101 from second end 124 with a velocity component opposite to external flow direction 160. Due to variation in local dynamic pressure of the approaching external flow at a leading portion 253 and a trailing portion 254 of exposed portions 252 of spalled region 250, adaptive cooling openings 120 toward a central area of spalled region 250 will flow less cooling fluid 101, while adaptive cooling openings 120 nearest to exposed portions 252 of spalled region 250 will flow more cooling fluid 101, again inhibiting overheating and further spalling of coating system 200.

In alternative embodiments, adaptive cooling openings 120 are oriented in any suitable fashion that enables adaptive cooling openings 120 to function as described herein.

Figure 7:
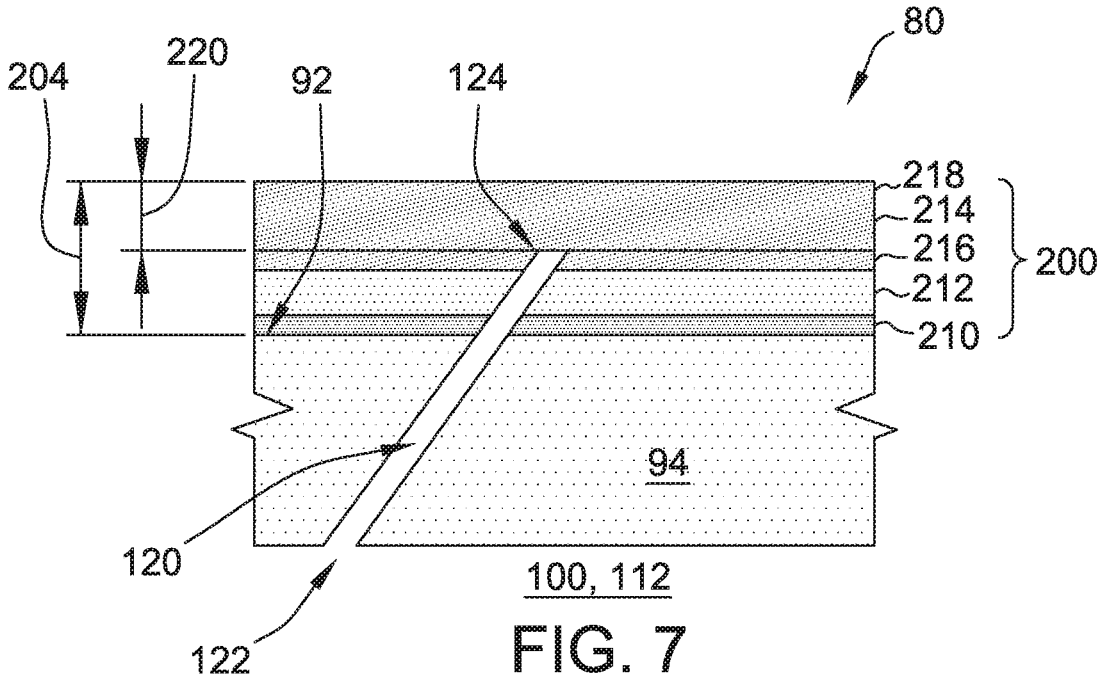
FIG. 7 is a schematic sectional view of another exemplary outer wall of the component shown in FIGS. 2 and 3.
Figure 8:
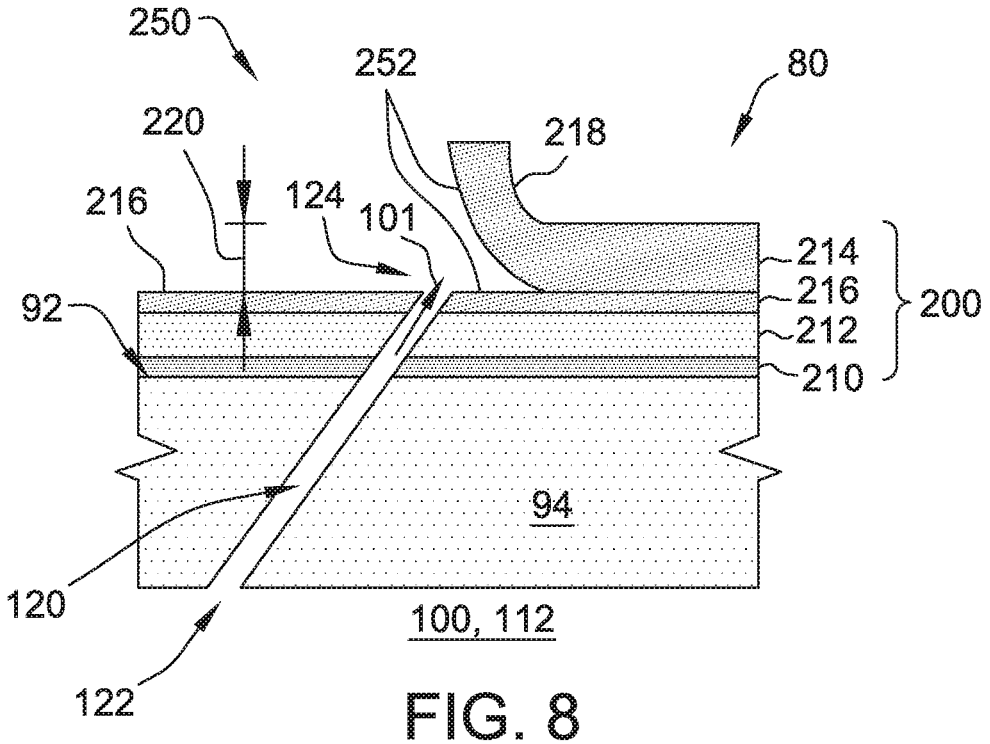
FIG. 8 is a schematic sectional view of the exemplary outer wall of FIG. 7 including another exemplary spalled region.

FIG. 7 is a schematic sectional view of another exemplary embodiment of outer wall 94 of component 80. FIG. 8 is a schematic sectional view of outer wall 94 including another exemplary spalled region 250. In the illustrated embodiment, coating system 200 includes a bond coat layer 210 adjacent to, and configured to adhere to, exterior surface 92, and at least one additional layer adjacent to bond coat layer 210. More specifically, in the exemplary embodiment, coating system 200 also includes an intermediate layer 212 adjacent to, and configured to adhere to, bond coat layer 210, and an outer, or insulating, layer 214 adjacent to, and configured to adhere to, intermediate layer 212. For example, in the exemplary embodiment, bond coat layer 210 is an aluminum rich material that includes a diffusion aluminide or McrAlY, where M is iron, cobalt, or nickel, and Y is yttria or another rare earth element. In alternative embodiments, bond coat layer 210 is any suitable material that enables bond coat layer 210 to function as described herein. In the exemplary embodiment, intermediate layer 212 includes a yttria-stabilized zirconia. In alternative embodiments, intermediate layer 212 is any suitable material that enables intermediate layer 212 to function as described herein. In the exemplary embodiment, insulating layer 214 is an ultra-low thermal conductivity ceramic material that includes, for example, a zirconium or hafnium base oxide lattice structure ($ZrO_2$ or $HfO_2$) and an oxide stabilizer compound (sometimes referred to as an oxide "dopant") that includes one or more of ytterbium oxide ($Yb_2O_3$), yttria oxide ($Y_2O_3$), hafnium oxide ($HfO_2$), lanthanum oxide ($La_2O_3$), tantalum oxide ($Ta_2O_5$), and zirconium oxide ($ZrO_2$). In alternative embodiments, insulating layer 214 is any suitable material that enables insulating layer 214 to function as described herein. In alternative embodiments, coating system 200 includes any suitable number and type of layers.

As discussed above, adaptive cooling openings 120 each extend from a first end 122, in flow communication with the at least one plenum 110, outward through exterior surface 92 and to a second end 124. In the embodiment illustrated in FIGS. 7 and 8, second end 124 is defined in coating system 200 such that adaptive cooling opening 120 extends partially into coating system 200. Upon entry of component 80 into service, second end 124 of adaptive cooling opening 120 is covered underneath a portion of coating system 200 having a non-zero depth 220.

In the exemplary embodiment, second end 124 is disposed within outer or insulating layer 214 of coating system 200, such that adaptive cooling opening 120 extends through an entire thickness of bond coat layer 210 and intermediate layer 212, and through a thickness of only a first, interior portion 216 of insulating layer 214, such that second end 124 is covered beneath depth 220 of a remaining second, exterior portion 218 of insulating layer 214. Thus, when spalled region 250 is created to a depth at least equal to depth 220 of second portion 218 of insulating layer 214, as illustrated in FIG. 8, second end 124 of each adaptive cooling opening 120 within spalled region 250 becomes completely unobstructed, creating a flow channel for cooling fluid 101 to pass from the at least one plenum 110 through adaptive cooling openings 120 to an exterior of outer wall 94, thereby providing additional localized cooling (e.g., bore cooling and/or exterior film cooling) for outer wall 94 and exposed portions 252 of coating system 200 in spalled region 250, in addition to the cooling provided by the internal cooling circuit within component 80. In alternative embodiments, second end 124 is defined at any suitable depth 220 within coating system 200 and/or terminates at or within any suitable layer of coating system 200 that enables adaptive cooling openings 120 to function as described herein.

For example, in some embodiments, spalled region 250 tends to originate as a delamination of second portion 218 of insulating layer 214 from first portion 216 of insulating layer 214, and a typical depth 220 of second portion 218 may be determined empirically for each region of outer wall 94. A design position of second end 124 for adaptive cooling openings 120 in each region of outer wall 94 is then selected to correspond to the typical depth 220 for that region, such that adaptive cooling openings 120 become active at the most common initial delamination depth for each region of outer wall 94. Thus, a depth of second end 124 of adaptive cooling openings 120 is selected to facilitate mitigation of the initial delamination spallation event, for example by maintaining an integrity of outer wall 94 and/or the remaining layers of coating system 200 in region 250 and/or preventing a size of spalled region 250 from growing. In alternative embodiments, the design position of second end 124 is selected in any suitable fashion that enables adaptive cooling openings 120 to function as described herein.

In alternative embodiments, second end 124 is defined at an interface between bond coat layer 210 and intermediate layer 212, and intermediate layer 212 and first portion 216 of insulating layer 216 are porous materials, such that delamination or spalling of insulating layer 214 to depth 220 enables flow of cooling fluid 101 through second end 124, porous intermediate layer 212, and porous first portion 216 to an exterior of coating system 200, as described above. In other alternative embodiments, a placement of second end 124 and a porosity of at least one layer of coating system 200 are selected in any suitable fashion to enable increased flow through adaptive cooling openings 120 in response to a spall or delamination event of a corresponding depth. For example, second end 124 is defined at the interface between bond coat layer 210 and intermediate layer 212, and intermediate layer 212 is a porous material, such that delamination or spalling of an entire thickness of insulating layer 214 enables flow of cooling fluid 101 through second end 124 and porous intermediate layer 212 to an exterior of coating system 200, as described above.

Figure 9:
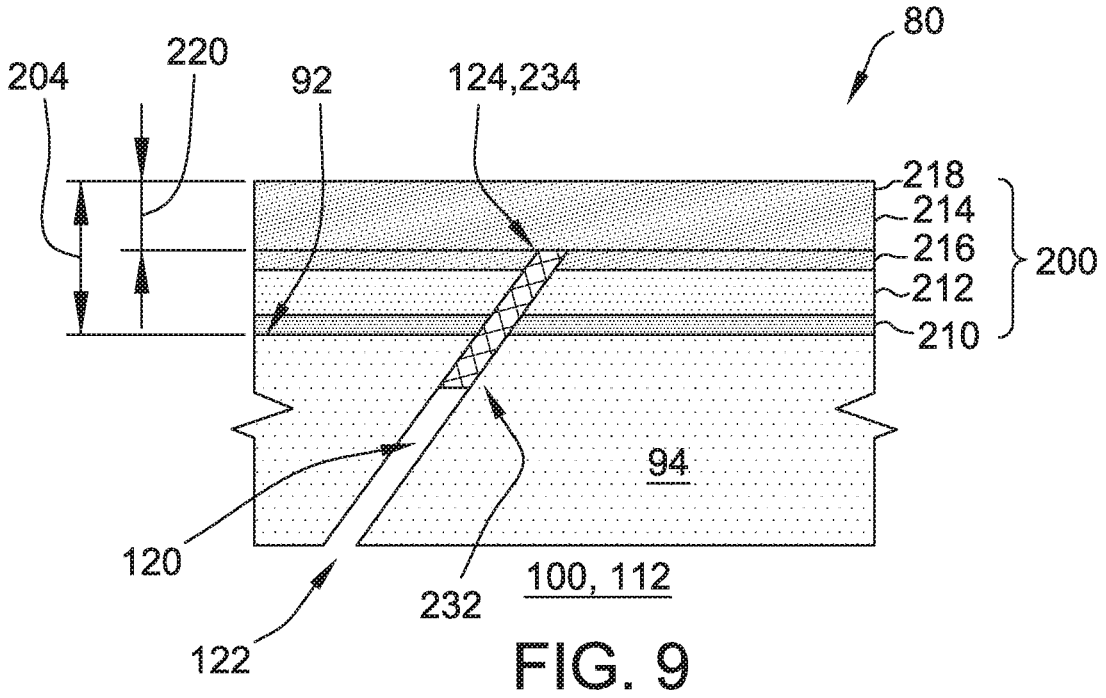
FIG. 9 is a schematic sectional view of an exemplary stage of manufacture of the exemplary outer wall of FIG. 7.

FIG. 9 is a schematic sectional view of an exemplary stage of manufacture of outer wall 94 as shown in FIG. 7. In the exemplary embodiment, a first portion of adaptive cooling openings 120, extending from first end 122 to exterior surface 92, is initially formed in outer wall 94 prior to adding coating system 200 to outer wall 94. For example, component 80 is initially formed with outer wall 94 not including adaptive cooling openings 120, and the first portion of adaptive cooling openings 120 is subsequently formed in outer wall 94 by a suitable machining process. For another example, component 80 is initially formed with outer wall 94 including the first portion of adaptive cooling openings 120 defined therein. More specifically, outer wall 94 is formed by casting molten metallic component material 78 around a core shaped to define the first portion of adaptive cooling openings 120 therein, or outer wall 94 is formed by an additive manufacturing process in which adaptive cooling openings 120 are defined within thin layers of component material 78 deposited successively to form outer wall 94.

In some embodiments, prior to or during disposing of coating system 200 on exterior surface 92, a cap 230 is deployed at second end 124 of each adaptive cooling opening 120 to define adaptive cooling openings 120 beneath at least a portion of coating system 200. In the exemplary embodiment, caps 230 are oblong members inserted into the first portion of adaptive cooling openings 120. More specifically, each cap 230 extends from a first end 232 sized and shaped to be received in the first portion of a corresponding adaptive cooling opening 120, to a second end 234 sized and shaped to extend outward from exterior surface 92 to define second end 124 of the corresponding adaptive cooling opening 120. After caps 230 are positioned with second end 234 extending from exterior surface 92, coating system 200 is disposed on exterior surface 92 around and over caps 230, such as in successive layers using a suitable spray deposition process. After coating system 200 is formed to the selected thickness 204, second end 234 of each cap 230 defines second end 124 of the corresponding adaptive cooling opening 120 at depth 220 within coating system 200, as illustrated in FIG. 9.

In another embodiment, cap 230 is a flat cover or blanket (not shown) that is positioned over the exposed outer end of each adaptive cooling opening 120 during each phase of a deposition of coating system 200, until adaptive cooling openings 120 are defined all the way to cap 230 at second end 124. In other alternative embodiments, caps 230 have any suitable structure that enables adaptive cooling openings 120 to be formed as described herein.

In some embodiments, after coating system 200 is formed, caps 230 are removed from outer wall 94 prior to entry of component 80 into service. For example, caps 230 are formed from a material that is removable from component 80 in a suitable leaching process prior to entry of component 80 into service. For another example, caps 230 are formed from a material that is configured to be melted and drained from component 80 in a suitable heating process prior to entry of component 80 into service. In other embodiments, caps 230 are not removed prior to entry of component 80 into service, but rather remain in place until spalled region 250 (shown in FIG. 8) is formed over caps 230. For example, caps 230 are formed from a material that is configured to rapidly burn away and/or fly away when caps 230 are exposed to the high temperature environment associated with spalled region 250, thus enabling second end 124 of the corresponding adaptive cooling opening 120 to become unobstructed and create a flow channel for cooling fluid 101 to pass from the at least one plenum 110 through adaptive cooling opening 120 to an exterior of outer wall 94, as described above.

Figure 10:
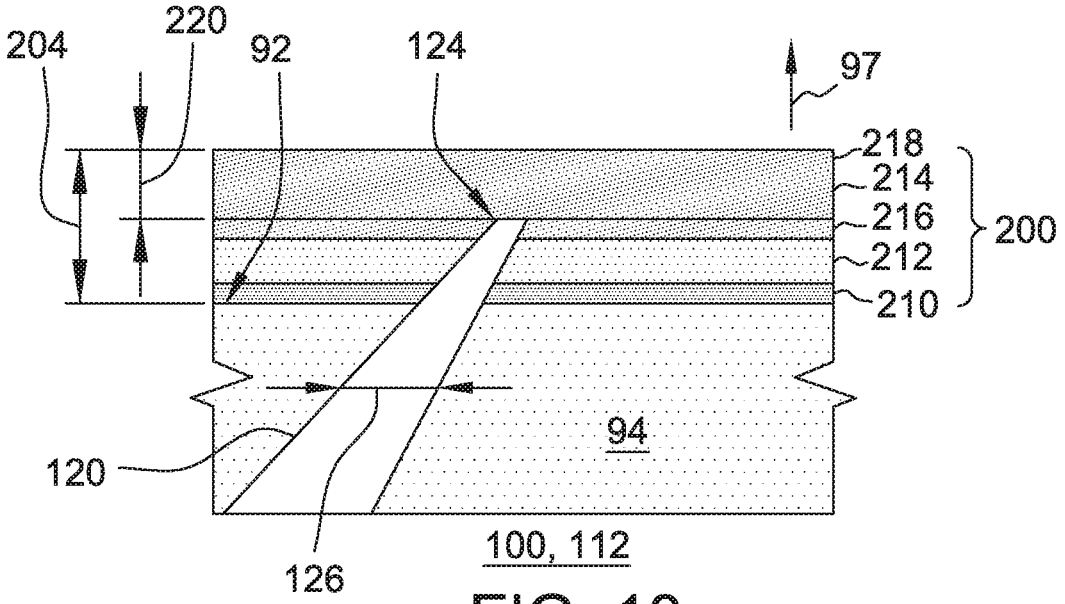
FIG. 10 is a schematic sectional view of another exemplary outer wall of the component shown in FIGS. 2 and 3.

FIG. 10 is a schematic sectional view of another exemplary embodiment of outer wall 94 including adaptive cooling openings 120. A cross-sectional area 126 of adaptive cooling openings 120 is defined perpendicular to normal direction 97. In certain embodiments, cross-sectional area 126 generally decreases between first end 122 and second end 124. For example, in the exemplary embodiment, adaptive cooling opening 120 defines a generally frusto-conical shape within outer wall 94, such that cross-sectional area 126 is generally circular and decreases between first end 122 and second end 124. In alternative embodiments, each adaptive cooling opening 120 defines any suitable shape that enables adaptive cooling opening 120 to function as described herein.

In some such embodiments, when spalled region 250 (shown in FIG. 8) is created over adaptive cooling opening 120, successively deeper portions of coating system 200 and, in some cases, outer wall 94 oxidize, i.e., "burn through," or otherwise are removed to a depth greater than depth 220 of second end 124. Because cross-sectional area 126 generally increases beyond second end 124 towards first end 122, an increasing depth of spalled region 250 beyond depth 220 tends to correspondingly increase the exposed cross-sectional area 126 of adaptive cooling openings 120 in spalled region 250, thereby increasing the escape of cooling fluid 101 through adaptive cooling openings 120 and enhancing the adaptive film cooling effect. In some such embodiments, a shape of adaptive cooling openings 120 is preselected to provide a varying cross-sectional area 126 that automatically "tunes" the amount of film cooling provided in response to a severity (e.g., width or depth) of the degradation to coating system 200 and/or outer wall 94. For example, as material burns or flies away from exposed portions 252 of coating system 200, cross-sectional area 126 opens larger and larger until enough cooling flow is being emitted from adaptive cooling openings 120 to stop any further degradation of coating system 200.

Figure 11:
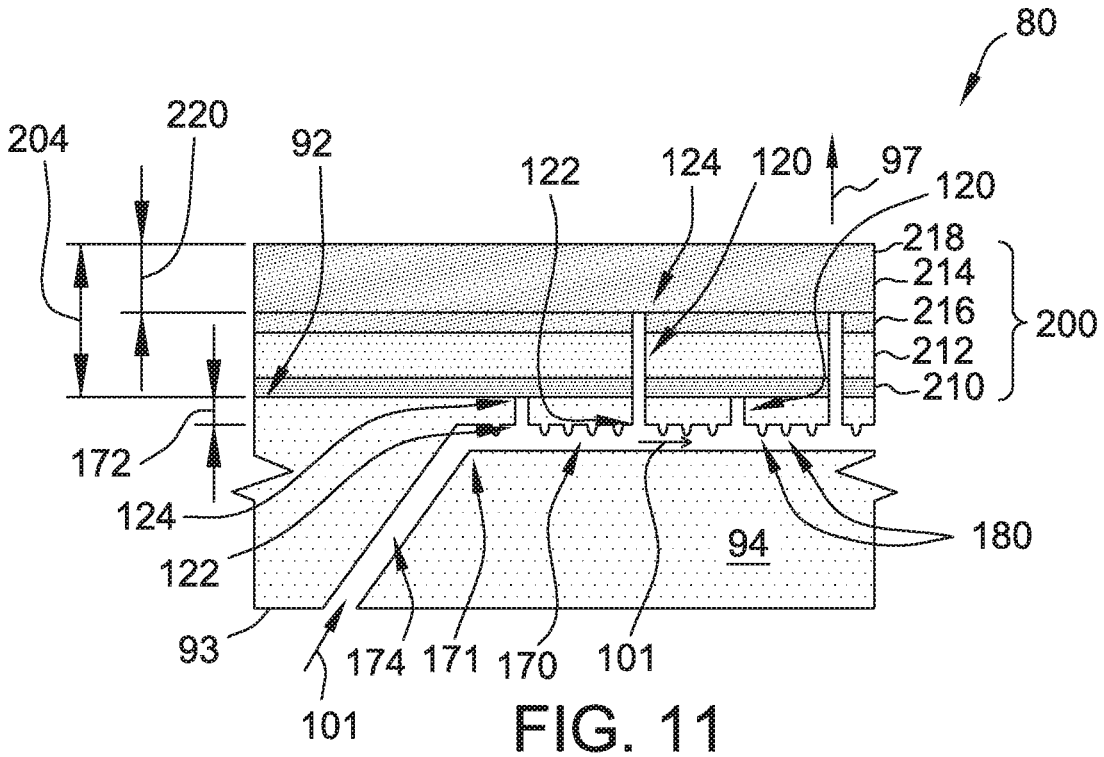
FIG. 11 is a schematic sectional view of another exemplary outer wall of the component shown in FIG. 2, including another exemplary embodiment of adaptive cooling openings.

FIG. 11 is a schematic sectional view of another embodiment of outer wall 94 of component 80, including another embodiment of adaptive cooling openings 120. In the embodiment of FIG. 11, component 80 does not include inner wall 96 and chamber 112, and outer wall 94 is not a relatively thin wall configured to receive impingement cooling. Outer wall 94 includes at least one channel 170 defined therein and extending generally parallel to exterior surface 92 at a depth 172 from exterior surface 92. For example, the at least one channel 170 is a plurality of suitable microchannels 170 configured to channel cooling fluid 101 therethrough in proximity to exterior surface 92 to provide cooling to exterior surface 92. In the exemplary embodiment, each channel 170 is in flow communication with the at least one plenum 110 via a corresponding access opening 174 defined within outer wall 94 between the at least one plenum 110 and a first end 171 of channel 170. In alternative embodiments, each channel 170 is in flow communication with the at least one plenum 110 in any suitable fashion that enables channel 170 to function as described herein.

In certain embodiments, channel 170 includes turbulators 180 along a surface that defines channel 170. Turbulators 180 are configured to introduce and/or increase turbulence in the flowfield of cooling fluid 101 within channel 170 to facilitate enhanced heat transfer. In the exemplary embodiment, turbulators 180 are implemented as a series of bumps along the surface that defines channel 170. In alternative embodiments, turbulators 180 are implemented as one of dimples, ribs, other variations in a cross-sectional area of channel 170, areas of surface roughness, and any other structure that enables turbulators 180 to function as described herein. In other alternative embodiments, channel 170 does not include turbulators 180.

In the exemplary embodiment, each channel 170 extends to a second end (not shown) that extends through exterior surface 92 and coating system 200, and cooling fluid 101 is exhausted into the working fluid through the second end of channel 170. In alternative embodiments, each channel 170 extends to a second end (not shown) that returns cooling fluid 101 to another location, for example a location within rotary machine 10, in a closed cooling circuit.

Each adaptive cooling opening 120 again extends from first end 122 in flow communication with the at least one plenum 110, outward through exterior surface 92 and to a second end 124. In the exemplary embodiment, first end 122 intersects and is in flow communication with channel 170. In alternative embodiments, first end 122 is defined at any suitable location within outer wall 94 that is in flow communication with the at least one plenum 110 via channel 170 and/or access opening 174.

In some embodiments, as described above, second end 124 is defined at and extends through exterior surface 92 of outer wall 94. In other embodiments, second end 124 is defined in coating system 200 such that adaptive cooling opening 120 extends partially into coating system 200, and is positioned at a depth 220 within coating system 200. Examples of both embodiments are shown in FIG. 11. In either case, upon entry of component 80 into service, second end 124 of each adaptive cooling opening 120 is covered underneath at least a portion of coating system 200, such that cooling fluid 101 cannot be exhausted through outer wall 94 via adaptive cooling openings 120. In other words, upon entry of component 80 into service, adaptive cooling openings 120 again are dead-ended by coating system 200. Thus, when spalled region 250 is created to a depth at least equal to depth 220 of second portion 218 of insulating layer 214, as illustrated in FIG. 8, second end 124 of each adaptive cooling opening 120 within spalled region 250 becomes unobstructed, creating a flow channel for cooling fluid 101 to pass from the at least one plenum 110 through adaptive cooling openings 120 to an exterior of outer wall 94, as described above.

Although adaptive cooling openings 120 are illustrated in FIG. 11 as each extending from first end 122 to second end 124 in direction 97 generally normal to outer wall 94, in certain embodiments an orientation of at least one adaptive cooling opening 120 is again other than normal to outer wall 94. More specifically, in certain embodiments, at least one adaptive cooling opening 120 is again oriented at an acute angle 142, relative to direction 97, as described above with respect to FIG. 6, for example. Moreover, in some such embodiments, groups of adaptive cooling openings 120 are oriented in arrangement 150 or another suitable arrangement, also as described above with respect to FIG. 6, for example to facilitate directing cooling fluid 101 toward exposed portions 252 of spalled region 250 and/or to facilitate channeling cooling fluid 101 from second end 124 with a velocity component opposite to external flow direction 160 (shown in FIG. 5).

The above-described embodiments enable improved mitigation of spalling or other degradation of exterior surfaces of internally cooled components, as compared to at least some known cooling systems. Specifically, the embodiments described herein include a component that includes a coating system disposed on the exterior surface, and a plurality of adaptive cooling openings defined in the outer wall. Each of the adaptive cooling openings extends from a first end in flow communication with at least one plenum interior to the component, outward through the exterior surface and to a second end covered underneath at least a portion of the thickness of the coating system, such that flow through the adaptive cooling openings is obstructed by the coating system when the component enters into service. Once in service, local damage to the coating system, for example by a spall event, uncovers the second end of the adaptive cooling openings, and cooling fluid from an internal cooling fluid pathway is channeled through the adaptive cooling openings to an exterior of the component, providing localized film or bore cooling to mitigate, for example, the spall event. Also specifically, in some embodiments, the adaptive cooling openings are oriented within the outer wall to facilitate inhibiting the spalled region from growing, for example by ensuring that at least some adaptive cooling openings are angled towards the edge of the spalled region, wherever it may occur.

An exemplary technical effect of the methods, systems, and apparatus described herein includes at least one of: (a) mitigating an effect of spalling or other degradation of a thermal barrier coating on the exterior surface and/or on the remaining coating of an internally cooled component; (b) selecting a depth of the ends of the adaptive cooling openings underneath the initial thickness of the coating system based on empirical observation of the most common local depth of spall and/or other coating system delamination events; and (c) automatically "modulating" an amount of additional local cooling based on the size and depth of the spall region.

Exemplary embodiments of adaptively cooled components are described above in detail. The components, and methods and systems using such components, are not limited to the specific embodiments described herein, but rather, components of systems and/or steps of the methods may be utilized independently and separately from other components and/or steps described herein. For example, the exemplary embodiments can be implemented and utilized in connection with many other applications that are currently configured to use components in high temperature environments.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A component comprising:

an outer wall comprising an exterior surface;

at least one plenum defined interiorly to said outer wall and configured to receive a cooling fluid therein;

a coating system disposed on said exterior surface, said coating system having a thickness; and a plurality of adaptive cooling openings defined in said outer wall, each of said adaptive cooling openings extends from a first end in flow communication with said at least one plenum, outward through said exterior surface and partially into said coating system to a second end covered underneath at least a portion of, but less than an entirety of said thickness of, said coating system, wherein said coating system seals said second ends of each of said adaptive cooling openings against flow communication through said second ends to an exterior of said component.

2. The component of claim 1, wherein said coating system comprises a bond coat layer and at least one additional layer, said bond coat layer being adjacent to said exterior surface, said second end disposed within said at least one additional layer.

3. The component of claim 2, wherein said at least one additional layer comprises an intermediate layer and an outer layer, said second end is disposed within said outer layer.

4. The component of claim 1, wherein at least one of said adaptive cooling openings is oriented at an acute angle relative to a direction normal to said outer wall.

5. The component of claim 4, further comprising groups of said adaptive cooling openings in an arrangement, wherein each said adaptive cooling opening in each of said groups is rotated by said acute angle in a different direction from others of said adaptive cooling openings in said group.

6. The component of claim 1, further comprising:

an inner wall defined interiorly to said outer wall, said inner wall comprising apertures defined therein and extending therethrough, said at least one plenum defined interiorly to said inner wall; and at least one chamber defined between said inner and outer walls, said apertures configured to direct impingement jets of the cooling fluid from said at least one plenum through said at least one chamber towards said outer wall, said first end is coupled in flow communication with said at least one chamber.

7. The component of claim 1, wherein said first end is coupled in flow communication with a channel that extends generally parallel to said exterior surface within said outer wall, said channel being in flow communication with said at least one plenum.

8. The component of claim 1, wherein a cross-sectional area of said adaptive cooling openings generally decreases between said first end and said second end.

9. The component of claim 1, wherein said coating system comprises a bond coat layer, an intermediate layer, and an outer layer, said bond coat layer being adjacent to said exterior surface and said intermediate layer being between said bond coat layer and said outer layer.

10. The component of claim 9, wherein each of said adaptive cooling openings extend through said bond coat layer and said intermediate layer, said adaptive cooling openings further extending into said outer layer such that each of said second ends are disposed within said outer layer.

11. The component of claim 9, wherein said second ends are each defined at an interface between said bond coat layer and said intermediate layer.

12. The component of claim 9, wherein said outer layer includes an ultra-low thermal conductivity ceramic material.

13. A rotary machine comprising:

a combustor section configured to generate combustion gases;

a turbine section configured to receive the combustion gases from said combustor section and produce mechanical rotational energy therefrom, wherein a path of the combustion gases through said rotary machine defines a hot gas path; and a component proximate said hot gas path, said component comprising:

an outer wall comprising an exterior surface;

at least one plenum defined interiorly to said outer wall and configured to receive a cooling fluid therein;

a coating system disposed on said exterior surface, said coating system having a thickness; and a plurality of adaptive cooling openings defined in said outer wall, each of said adaptive cooling openings extends from a first end in flow communication with said at least one plenum, outward through said exterior surface and partially into said coating system to a second end covered underneath at least a portion of, but less than an entirety of said thickness of, said coating system, wherein said coating system seals said second ends of each of said adaptive cooling openings against flow communication through said second ends to an exterior of said component.

14. The rotary machine of claim 13, wherein said outer wall is formed from one of a metallic alloy and a ceramic matrix composite.

15. The rotary machine of claim 13, wherein said turbine section comprises a plurality of rotor blades and a plurality of stator vanes, said component comprises one of said rotor blades and said stator vanes, and wherein said plurality of adaptive cooling openings is disposed on a leading edge of said component.

16. The rotary machine of claim 13, wherein at least one of said adaptive cooling openings is oriented at an acute angle relative to a direction normal to said outer wall.

17. The rotary machine of claim 16, wherein said at least one adaptive cooling opening is oriented such that said second end is at least partially tilted into a local direction of working fluid flow over said outer wall, such that said at least one adaptive cooling opening is configured to channel the cooling fluid from said second end with a velocity component opposite to the local direction of working fluid flow when said coating system is spalled to expose said second end.

18. The rotary machine of claim 13, further comprising an auxiliary compressor upstream of said component, said auxiliary compressor configured to increase a pressure of the cooling fluid supplied to the at least one plenum in response to an additional flow of the cooling fluid required to feed said adaptive cooling openings in a spalled region of said component.

19. A method of making a component, said method comprising:

forming an outer wall that encloses at least one plenum, the at least one plenum configured to receive a cooling fluid therein, the outer wall including an exterior surface and a plurality of adaptive cooling openings defined in the outer wall; and disposing a coating system on the exterior surface, the coating system having a thickness, wherein each of the adaptive cooling openings extends from a first end in flow communication with the at least one plenum, outward through the exterior surface and partially into the coating system to a second end covered underneath at least a portion of but less than an entirety of the thickness of, the coating system, wherein the coating system seals the second ends of each of the adaptive cooling openings against flow communication through the second ends to an exterior of the component.

20. The method of claim 19, further comprising, at least one of prior to and during said disposing the coating system on the exterior surface, deploying caps at the second ends of the adaptive cooling openings, wherein said disposing the coating system on the exterior surface comprises disposing the coating system around and over the caps.

* * * * *